US008151385B2

(12) United States Patent
Goskowski et al.

(10) Patent No.: US 8,151,385 B2
(45) Date of Patent: Apr. 10, 2012

(54) SHOWER CURTAIN RAIL AND GLIDE ASSEMBLY

(75) Inventors: M. Karen Goskowski, Forest City, PA (US); Gregory H. Millet, Syracuse, NY (US); John J. Fitzsimmons, Fayetteville, NY (US)

(73) Assignee: Kartri Sales Company, Inc., Forest City, PA (US)

( * ) Notice: Subject to any disclaimer, the term of this patent is extended or adjusted under 35 U.S.C. 154(b) by 706 days.

(21) Appl. No.: 12/235,690

(22) Filed: Sep. 23, 2008

(65) Prior Publication Data

US 2009/0119830 A1 May 14, 2009

Related U.S. Application Data

(60) Provisional application No. 60/986,679, filed on Nov. 9, 2007.

(51) Int. Cl.
*A47K 3/00* (2006.01)

(52) U.S. Cl. ..... 4/610; 4/608; 4/558; 160/124; 160/DIG. 6

(58) Field of Classification Search ..... 4/557–559, 4/605, 607–610; 248/214–215, 261–265; 160/123–124, 126, 196.1, 330, 341, 345, 160/349.1, 390, DIG. 6, DIG. 10; 16/87.2, 16/87.4 R, 93 D, 95 D, 95 R; D8/373, 367
See application file for complete search history.

(56) References Cited

U.S. PATENT DOCUMENTS

| | | | | | |
|---|---|---|---|---|---|
| 1,836,484 | A | * | 12/1931 | Meneley | 16/87.8 |
| 2,320,308 | A | * | 5/1943 | Silverman | 16/87.2 |
| 3,331,095 | A | * | 7/1967 | Hachtel | 16/96 D |
| 3,378,879 | A | * | 4/1968 | Stall | 16/87.4 R |
| 3,453,682 | A | * | 7/1969 | Salzmann | 16/87.4 R |
| 3,522,621 | A | * | 8/1970 | Ford et al. | 16/87.4 R |
| 3,587,131 | A | * | 6/1971 | Graf | 16/95 R |
| 3,637,084 | A | * | 1/1972 | Uitz | 211/105.1 |
| 5,101,522 | A | | 4/1992 | Prian | |
| D350,279 | S | * | 9/1994 | Tate | D8/373 |
| 5,421,059 | A | * | 6/1995 | Leffers, Jr. | 16/87.4 R |
| D436,024 | S | * | 1/2001 | Freedland | D8/367 |
| D441,276 | S | * | 5/2001 | Ho | D8/367 |
| 6,543,629 | B1 | * | 4/2003 | Samelson | 211/105.1 |
| D489,249 | S | * | 5/2004 | Moore | D8/367 |
| 7,523,778 | B2 | * | 4/2009 | Roberts et al. | 160/237 |
| 2006/0225244 | A1 | * | 10/2006 | Melinette et al. | 16/93 R |
| 2007/0050904 | A1 | * | 3/2007 | Harwanko | 4/558 |

FOREIGN PATENT DOCUMENTS

DE 10212030 A1 * 10/2003

* cited by examiner

*Primary Examiner* — Dinh Nguyen
*Assistant Examiner* — Jeffrey Dunn
(74) *Attorney, Agent, or Firm* — Bernhad P Molldrem, Jr.

(57) ABSTRACT

A shower curtain and support system employs an elongated rail supported at the shower or tub. The rail extrusion can be an extrusion with an inverted U profile, with an open slot or slots at its base. There are glides, e.g., nylon members with a ball, hemisphere, or other wide head portion and shaft that projects out through the slot from the open interior of the rail. The glides have one or two hook structures for attaching to a fabric curtain and a vinyl curtain liner. In one preferred version, there is a liner hook and spring retaining arm on one side that fits into the grommet at the top of the liner. On the other side is a short arm with a button that fits into a button hole on the cloth or fabric curtain. The curtain has blind button holes or grommets at its upper hem, so that the hook structure, e.g., button, does not show.

10 Claims, 10 Drawing Sheets

10
20
22
24
26
30
32
40
44
45
46
48
50
52
54
56
58A
58B
62

SHOWER CURTAIN RAIL AND GLIDE ASSEMBLY

This application claims priority of provisional appln. 60/986,679, Nov. 9, 2007.

BACKGROUND OF THE INVENTION

This invention relates to shower curtain support assemblies, i.e., shower curtain rod, curtain hook, curtain, and liner.

The invention is more particularly concerned with a novel shower curtain support assembly that employs a rail and glides that can be used in place of traditional shower curtain rod and shower curtain hooks that hook over the rod. The invention is more specifically directed to a shower curtain support system in which the hooks, i.e., the members that support the curtain and liner from the supporting rail (or curtain rod) are not visible, and provide the shower rail and curtain with an elegance and simplicity of design that has not been achievable in the past.

The typical shower curtain support system, as used in the home and in hotels and motels, uses a tubular shower curtain rod, typically of round or cylindrical shape, with shower curtain rings or hooks that hang on the rod and hold the shower curtain and any associated shower curtain liner. These shower curtain hooks are always visible in from outside the tub or shower, and require space between the top hem of the shower curtain and the shower rod. Also, because the shower curtain hooks have to be able to slide along the outer surface of the shower curtain rod, there has to be an open space above the entire length of the rod. Efforts have been made to make the shower curtain hooks or rings more decorative, but the room for improvement in the aesthetics of the shower curtain hook is rather limited. Also, because the hooks have to be disposed on the rod and have to slide along it, it is difficult to add an attractive pattern or other decor directly onto the shower rod. Moreover, the shape of the traditional rod is limited to tubular, i.e. circular profiles.

OBJECTS AND SUMMARY OF THE INVENTION

Accordingly, it is an object of this invention to provide a shower curtain and curtain suspension arrangement that overcomes the drawbacks of the conventional systems of the prior art.

It is another object to provide an improved curtain rod not limited to round profiles, and to provide curtain suspension devices, i.e., glides, that can hold the shower curtain and not be visible from the proximal side, i.e., outside the shower area.

It is a related object to provide a shower rod or rail, and associated glides, that hold the shower curtain and a shower curtain liner in place adjacent the rail.

Another object is to provide a shower curtain, and means for suspending same from the shower curtain rod or rail, in which the shower curtain is provided with blind eyelets or buttonholes at its top hem, so that the glide or other curtain suspension hardware is hidden and not visible from outside of the shower area.

According to an aspect of this invention, the system employs glides that travel within a rail member, and which have an arm or similar structure that projects from a slot or similar opening in the rail to support the shower curtain and/or liner. The rail can be extruded from an aluminum alloy, and can be coated or painted or printed so as to match the room decor in the bathroom where the shower curtain is installed. In some cases, a sturdy plastic rail could be extruded or molded.

In accordance with an aspect of this invention, in place of a traditional shower rod, a rail in the form of an elongated extrusion is supported at the shower or tub. The rail extrusion can be in the form of an inverted U profile, with inwardly directed lips at the lower side, and with the open lower side to defining a slot. There are glides, e.g., nylon members with a ball, hemisphere, or other wide head portion and shaft or shafts that project out through the slot from the open interior of the rail. Each shaft can have one or two hook structures for attaching to the curtain or to a fabric curtain and a vinyl curtain liner. In one preferred version, there is a liner hook and spring arm on one side that fits into the grommet at the top of the liner. The spring arm secures the grommet on the liner hook, but can be squeezed up so the liner can be removed. On the other side is a short arm with a button that fits into a button hole on the cloth or fabric curtain. Preferably, the curtain has blind button holes (or equivalently, grommets) at the upper hem, i.e., formed only in the tub side of the upper hem, so that the hook structure, such as the button, does not show.

The slot can have an insertion hole near one end, i.e., wide enough to allow the heads of the glides, so that the glides can be inserted or removed. A leaf spring installed inside the rail at this point assures that the glides are retained in the rail, so that they do not come out unless deliberately removed.

A one-piece glide is shown and described, and has the advantages of simplicity, compactness, and economy. However, in some cases the glide could be a hook suspended from wheels or rollers.

The invention is also directed to a shower curtain support system that makes it possible for the curtain to have blind button holes, slits, or grommets at its upper hem, so that the hanger hardware, i.e., hooks or glides, are not visible from outside the tub or shower space.

The ends of the rail are supported on wall mounts that can be attached to the walls with wood screws or equivalent fasteners. On one side is a single-piece wall mount, with a socket to receive the end of the rail, and a flat face that goes against the wall at the niche or recess for the shower or tub. On the other side is a clamshell wall mount, with an A portion that screws to the wall on the other end, and receives the other end of the rail when it is installed. Then a B portion is installed, and attached by one or more screws to the A portion. The screw(s) are received in blind threaded hole(s) in the A portion, so that the fastener hardware is not visible from the room outside the shower or tub.

The wall mounts can carry the same matching decorative finish as the rail (i.e., rod) or can have a contrasting decor.

Because the glides only need to travel inside the rail, the rail can be attached directly to ceiling or soffit, for a flush fit. It is also possible to suspend the shower support rail from above on rods or similar vertical supports that drop down from the ceiling, so that the shower curtain rail and glide system can be used on a free-standing tub, such as a claw-foot type tub.

The aluminum alloy extrusions used for the rail are simple and inexpensive to produce, and provide excellent support strength characteristics.

One alternative rail and glide structure has a slot or longitudinal opening at the back (or tub side) of the rail, and glides in the form of sliding blocks with a hook arm that projects back from the rail.

A group or series of LEDs or similar low power illuminating devices can be incorporated into the rail to throw illumination through the slot onto the shower curtain. This way, the shower curtain and suspension system can also serve as a night light.

An alternative glide member for a traditional tube shower curtain rod can be constructed in the form of a hook or ring, with a liner hook and with a shower curtain button member, so that the blind-eyelet or blind button-hole shower curtain can be retrofitted onto an existing shower rod installation.

A few preferred embodiments of this invention will be described below, with reference to the accompanying Drawing figures.

DETAILED DESCRIPTION OF THE PREFERRED EMBODIMENT(S)

Figure 1:
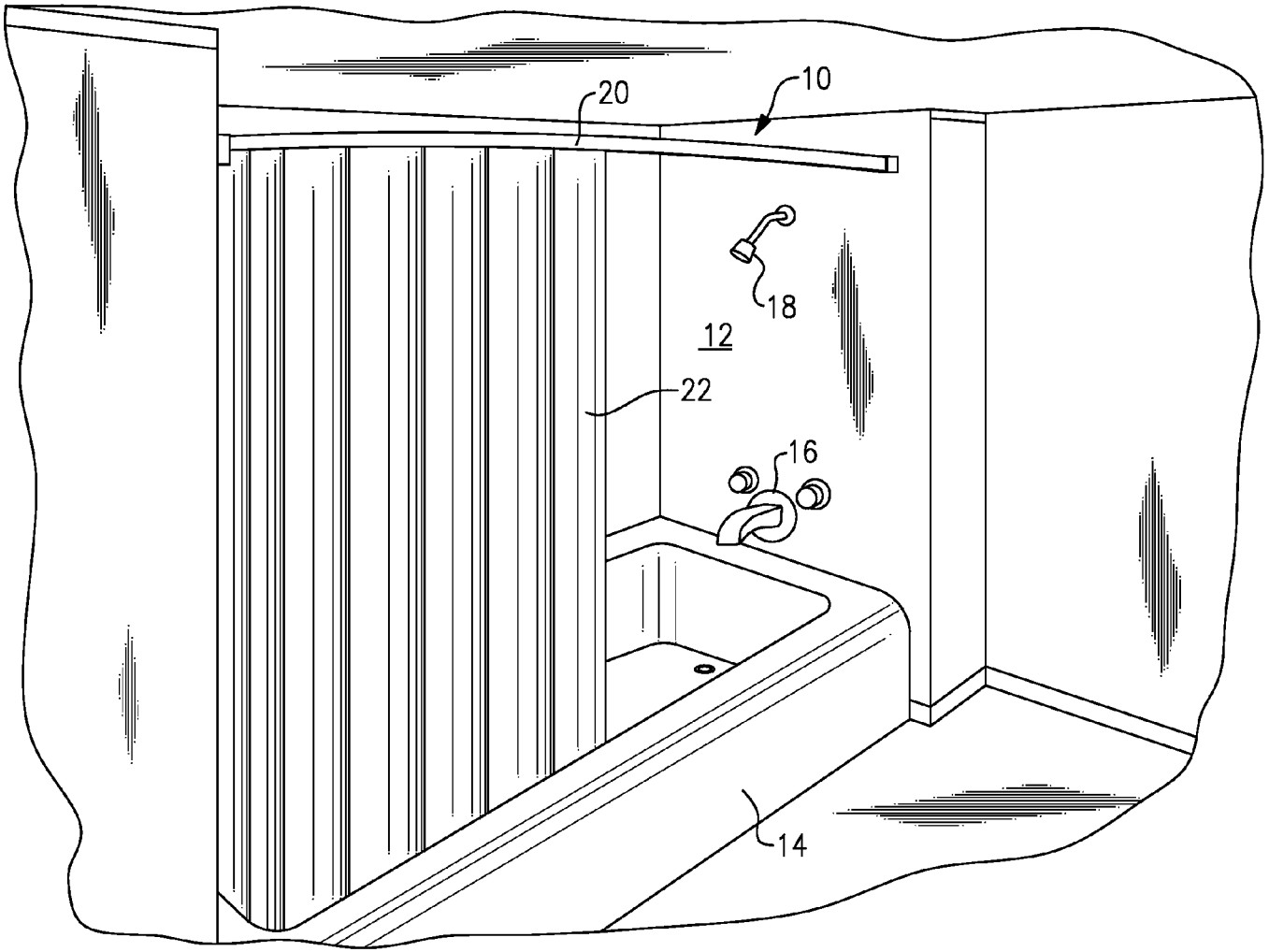
FIG. 1 is a perspective view of showing a standard bathtub installation, with shower curtain and a curtain support rail system according to one embodiment of the invention.

A shower and/or bath curtain and hanger assembly 10 according to one embodiment of this invention is shown in FIG. 1, in which a shower area 12 is formed of a tub 14 positioned between two end walls. Here, a bathtub faucet 16 is positioned on one end wall, and a shower head 18 is positioned above it on the same end wall above the tub 14 and within the shower area 12.

A shower curtain rod, here in the form of an elongated rail 20, is mounted at is ends to the respective end walls to close off the shower area 12. The rail 20 can be straight, or can be bowed outward. A shower curtain 22 is suspended from the rail 20 as is a curtain liner (not visible in this view), with the curtain and liner being held on hanger devices or "glides", which are to be described shortly.

Figure 2:
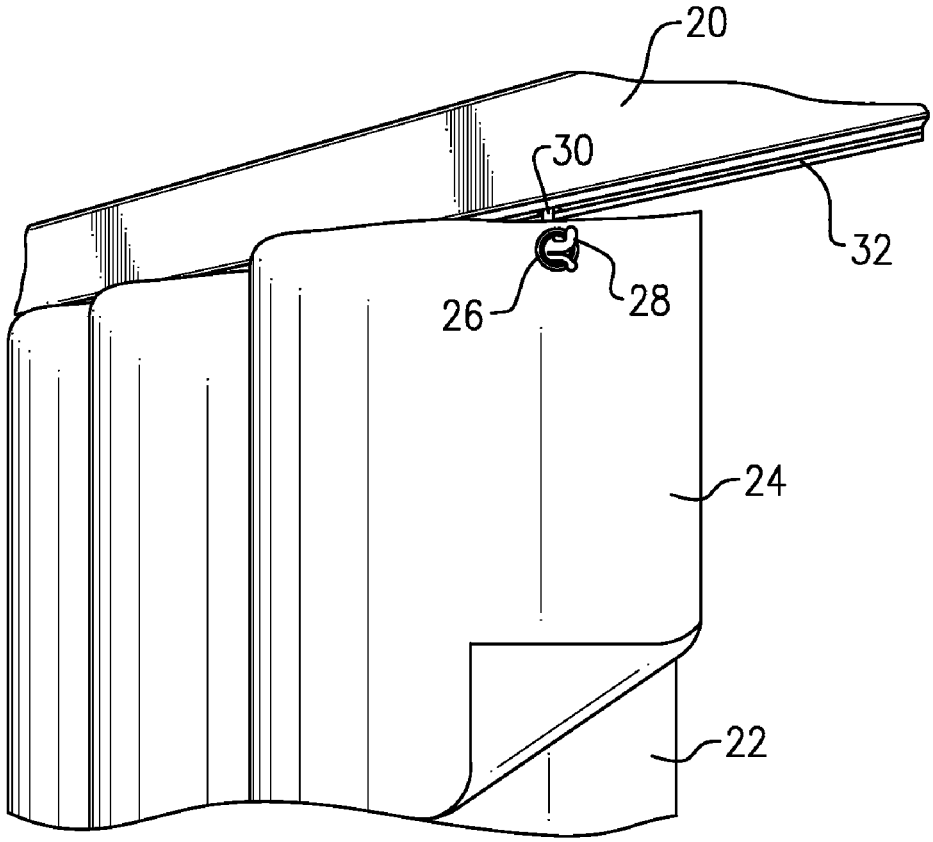
FIG. 2 shows an example of the curtain rail, here with one glide member projecting down through the slot at the lower side of the rail extrusion.

As shown in FIG. 2, the rail 20, as seen from inside the shower area 12, holds the shower curtain 22, which can be cloth, with a decorative print design, as well as a curtain liner, e.g., a sheet of clear or colored vinyl to serve as a water barrier. The liner has grommets 26 along its upper edge or hem, and hooks or horizontal arms 28 of glides 30 that are carried within the hollow interior of the shower rail 20, and which project out a slot 32 in the base or bottom side of the rail. One arm of the glide 30 is shown projecting through the grommet 26 in the vinyl shower curtain liner 24. On the other side of the glide 30, not visible here, is a button, which can be round or spade shaped, and which fits into a blind button hole or eyelet in an upper hem of the fabric shower curtain 22. The rail 20 does not carry the exterior sliding rings or hooks that are used with conventional shower rod systems, and so this rail 20 can be provided with a decorative finish. For example, the rail can be given a stone-look, marbled finish. The rail can also be painted or treated to match wall coverings in the shower area 12, or to match the pattern on the shower curtain 22.

Figure 3:
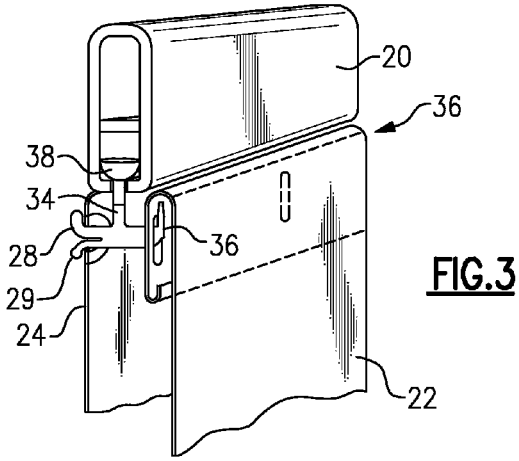
FIG. 3 is a cut-through perspective view showing the rail extrusion, glide, shower curtain and shower curtain liner of this embodiment.
Figure 4A:
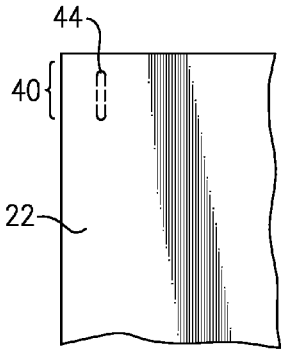
FIG. 4, consists FIGS. 4A, 4B, which are side and edge views of the unfinished top hem of the shower curtain of this embodiment, and FIGS. 4C and 4D, which are side and edge view of the finished top hem of the shower curtain.
Figure 4B:
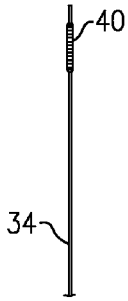
Figure 4C:
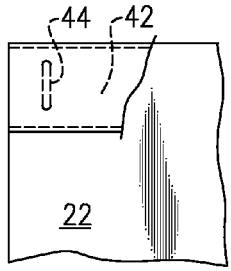
Figure 4D:
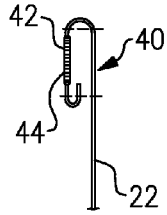

The rail 20 may be configured as generally shown in FIG. 3, as a generally inverted U-shape extruded member (e.g., an aluminum alloy), with a rounded top wall, two parallel side walls, and a pair of lips that project inward, i.e., towards one another to define a gap, i.e., the longitudinal slot 32, to be about ¼ inch across. There is also preferably a transverse brace wall or flange in the extruded rail that extends across between the two side walls for added support and rigidity.

The glide 30 may be a nylon member (or similar low-friction material) with a head 38 that can be round or hemispherical, a shaft or stem 34 that projects down through the slot 32, with hook structure on one or both sides at the end of the stem. The hook structure for the vinyl shower curtain liner 24 is shown at the left and in this embodiment comprises a two-part retainer structure, including the liner hook member 28, being generally rigid, and just below that a resilient spring arm 29. This is shown at the left side in FIG. 3, and is intended for supporting the grommet 26 of the vinyl curtain liner. At the other side, that is, on the right in this view, is a hook member 36 which ends in a flattened button 38, that penetrates a hole or slot in the upper hem edge 40 of the cloth or fabric curtain 22. Preferably, the curtain 22 has blind holes or grommets, on only the tub side or shower stall side of the fabric curtain.

FIG. 4 (consisting of the four views: FIG. 4A, FIG. 4B, FIG. 4C and FIG. 4 D) shows some of the shower curtain structure, in which the upper hem 40 is formed by turning down a narrow edge portion 42 at the upper edge, and sewing it. Eye slots 44, i.e., button holes, are formed through the narrow edge portion 42, so that the eye slots 44 are visible only on the one side of the curtain, i.e., the tub side in this embodiment. In some embodiments, the sewn hem can be facing outward, and the eye slots or button holes can be formed on the other side of the hem edge, depending on the designer's intentions.

Figure 5:
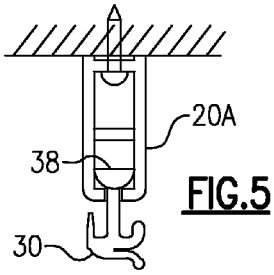
FIG. 5 and FIG. 6 are sectional views of an alternative shower curtain rail.
Figure 6:
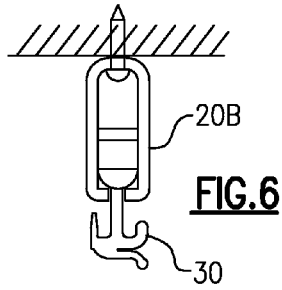

FIG. 5 shows an alternative flat-top extrusion 20A that can be employed with a direct ceiling mount or soffit mount, i.e., with the rail attached by wood screws or similar fasteners directly to the ceiling above, where a flush installation is desired. FIG. 6 shows a further extruded rail 20B for a similar ceiling or soffit direct installation, where the standard or inverted U-shape extrusion profile is used. These direct ceiling or soffit installations are possible because no part of the curtain hook structure has to travel along the top surface of the rail structure. Instead the glides 30 of the type described above are employed, and in each case the glide head 38 is entirely at the open lower part on the inside of the rail.

Figures 7A, 7B, 7C, 8:
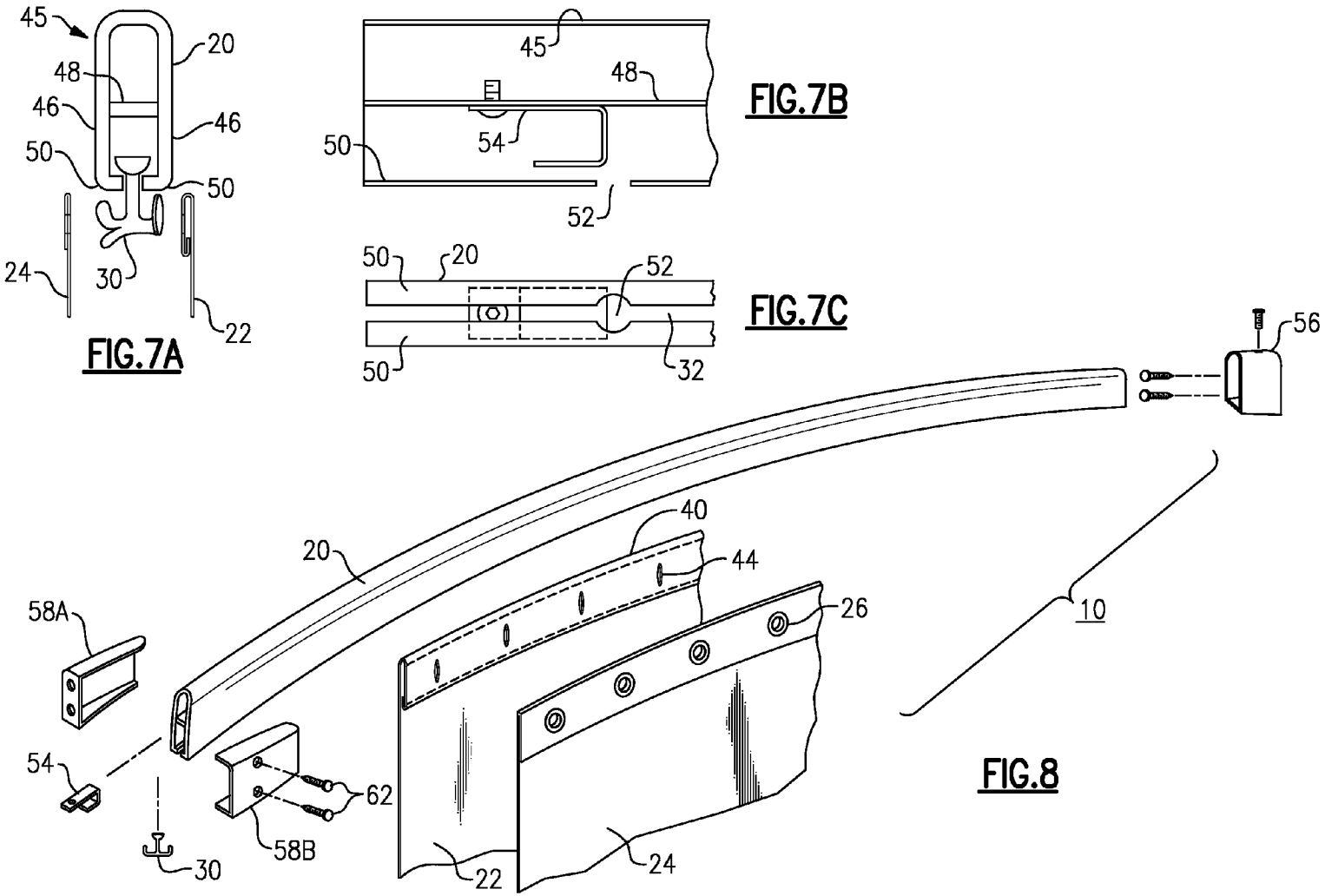
FIG. 7A is a sectional view of the shower curtain rail of this embodiment, together with glide, curtain, and liner.
FIGS. 7B and 7C are a partial longitudinal sectional view and a bottom plan view of one end of the shower curtain rail of this embodiment.
FIG. 8 is an assembly view of the shower curtain support system of this embodiment.

FIG. 7 consists of FIG. 7A (which shows a cross section of the rail 20 with glide 30, liner 24, and fabric curtain 22); FIG. 7B (which is a longitudinal section of one end of the rail 20); and FIG. 7C (which is a bottom view of that end of the rail). Here, the rail 20 is formed of the generally inverted U extrusion, with a rounded upper side 45, a pair of parallel side walls 46, a horizontal brace wall or flange 48, and a pair of inwardly directed lips 50, 50 at the open lower end and spaced apart to define the slot 32 for the glides 30. The slot 32 extends for the entire length of the rail member. The glide 30 is of the double-sided type, with the hook 28 and spring arm 29 (to the left) for the vinyl liner 24, and the button 38 (at the right) to fit a blind button hole at the upper hem of the fabric curtain 22.

FIGS. 7B and 7C show an insertion hole 52 that is provided on the slot 32 at or near the one end of the rail member 20. This hole 52 is dimensioned to admit passage of the heads 38 of the glides 30, so the glides can be inserted or removed at this point. A retainer spring 54 in the form of a leaf spring is installed at this position, with a free end at the position of the hole, and with a an anchor portion that is affixed to the horizontal brace wall 48 using a standard threaded fastener. Glides are inserted by pushing up through the insertion hole, and the spring keeps them from returning over the hole and coming out. However, a person can deliberately pull the glide to the position of the hole so the glide can be removed if desired.

FIG. 8 is a general assembly view of the shower curtain rail and glide system 10, with left (one-piece) left and right (two-piece) end mounts 56 and 58 for mounting to the end walls of the shower area 12, i.e., at the tub or shower stall.

The left end wall mount 56 (shown at the right in this view) is a one-part socket type support, with an opening to receive the left end of the rail, and a flat face that is positioned against the wall and attached with wood screws. This is attached to the wall before the rail is installed.

The rail 20 as shown here is nominally sixty-one inches (about 155 cm) in length, and is curved or bowed about five inches out from the tub or wet side.

At the left in this view is the mount 58, shown here as a two-part clamshell wall mount for the right end of the rail. This clamshell mount 58 has an "A" part 58A that attaches to the wall with screws before installation of the curtain support rail member, and a "B" part 58B that fits onto it after the end of the rail 20 has been set in place on the "A" part 58A. The "A" part of the clamshell mount 58 has an upstanding rib or lip on its bottom wall that fits into the slot of the rail member, so that the rail member does not twist or move after installation. The "B" part 58B is attached with one or two screws that are received in blind threaded openings in the inside wall of the "A" part 58A.

The retaining spring 54, and an example of a glide 30 are shown in this view, in relation to the fabric curtain 22 and the vinyl curtain liner 24.

Figure 9B:
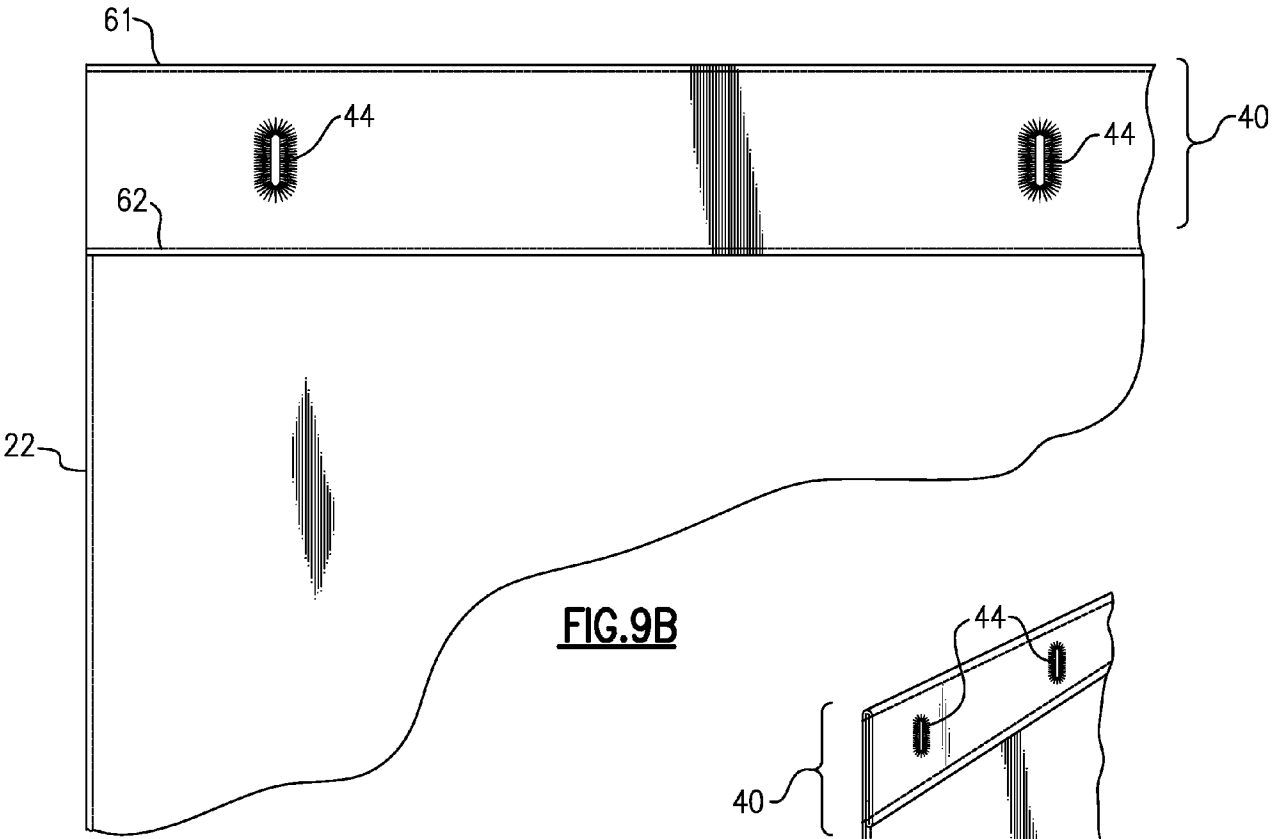
FIG. 9B is a rear view thereof.
Figure 9C:
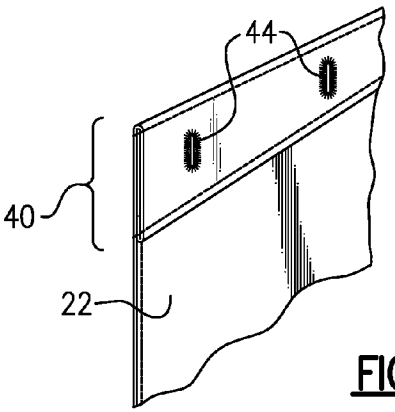
FIG. 9C is a perspective view thereof.
Figure 9A:
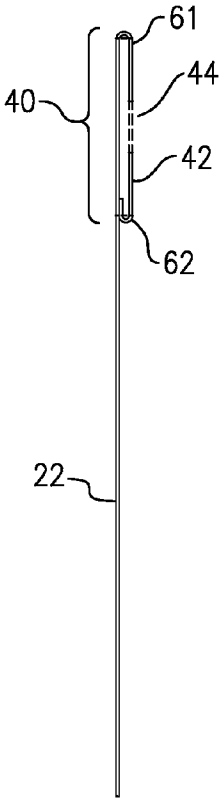
FIG. 9A is an end or edge view of the upper hem of the shower curtain employed in an embodiment of this invention.

FIG. 9 (formed of FIGS. 9A, 9B, and 9C) shows an example of the preferred shower curtain, with button holes 44 sewn and cut at the upper hem 40 of the shower curtain fabric 22. These button holes penetrate only one side of the upper hem, i.e., these are "blind" button holes, and are not visible from the outer or room side. For this type of curtain, the glide has a flattened button (round or oval, for example, or in some cases spade-shaped) that fits into a respective one of these button holes 44. The button holes are preferably repeated at a six inch spacing. The hem is one-and-one-half inches across, and the button holes have a length of one-half inch. Here the hem is sewn through at its top and at the base of the hem, and respective stitch lines 61 and 62 are shown here.

Figure 10:
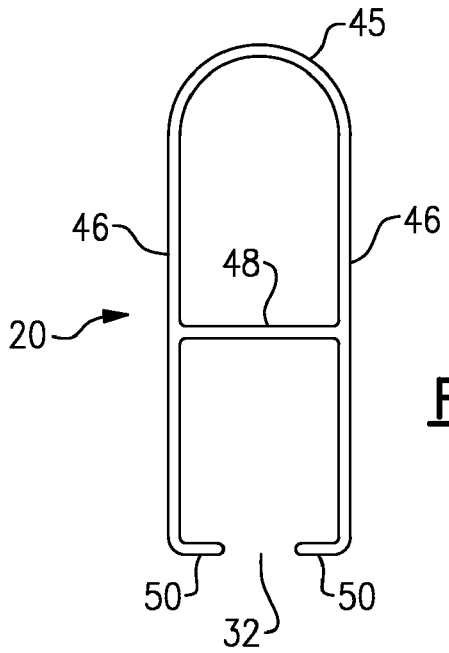
FIG. 10 shows the extrusion profile of the shower curtain support rail of a preferred embodiment.

FIG. 10 is a cross-sectional view showing the profile of the extrusion used in the shower curtain rail 20 of the preferred embodiment. The extrusion has a round, i.e., semicircular top wall 45, a pair of generally parallel side walls 46, 46, and a pair of inwardly directed lips 50, 50 at the lower, open side. These define the slot 32 between them, with a slot width of 0.25 inches in this embodiment. The lips 50 have radiused edges, with no sharp corners to catch the glides. The extrusion here has a uniform wall thickness of 0.060 inches, and is extruded of an aluminum alloy. Other suitable metals and plastics exist that could be employed, if desired.

The transverse support wall or support flange 48 is here shown as spaced about 0.75 inches above the lips 50.

Figure 11:
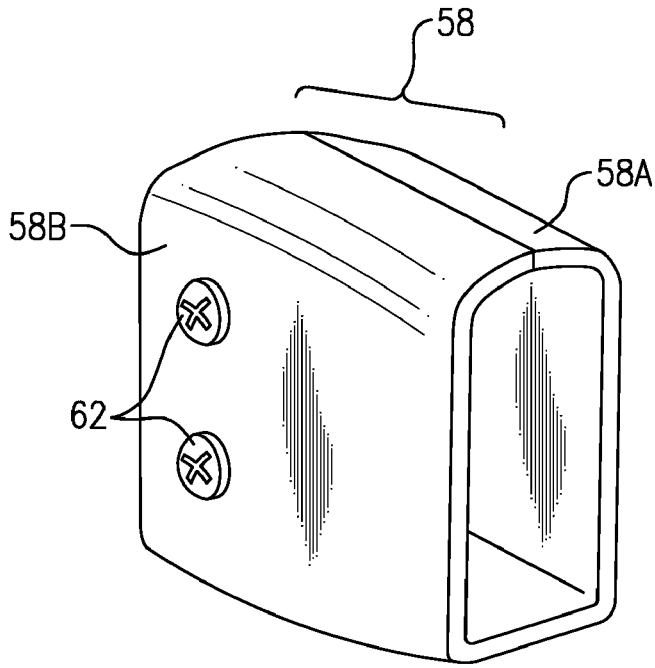
FIG. 11 is a perspective view of a two-part clamshell wall mount of a preferred embodiment.
Figure 12:
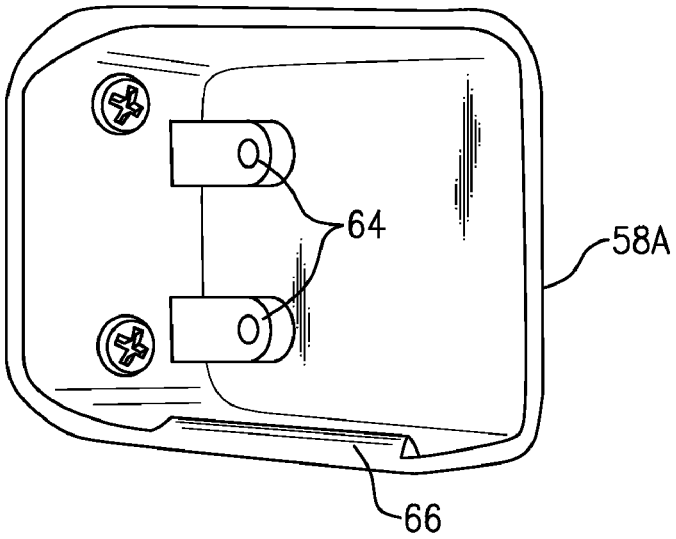
FIG. 12 is a perspective view of the outer portion thereof, showing blind screw holes.

FIG. 11 shows the right-end two-part clamshell mount that accepts the right end of the rail member. As discussed earlier, the B part 58B is installed over the open side or back side of the A part 58A. A pair of screws 62 are used to fasten the parts together, but in other styles of wall mounts, there could be a single screw or more than two screws, or another type of fastener could be used. As seen in FIG. 12, the A part has a pair of blind threaded screw holes 64 to receive the screw fasteners 62 so that the screw fasteners 62 will not be visible from outside the tub or shower.

FIG. 12 also shows a lip or rib 66 rising from the base or bottom wall of the clamshell A part 58A, which fits into the slot 32 of the extruded rail 20. The rib 66 snaps into the extrusion slot and holds the extrusion in place during assembly. Also, the rib 66 transfers considerable stress directly from the extrusion to the base of the A part 58A of the mount, and thus onto the wall fasteners.

Figure 13:
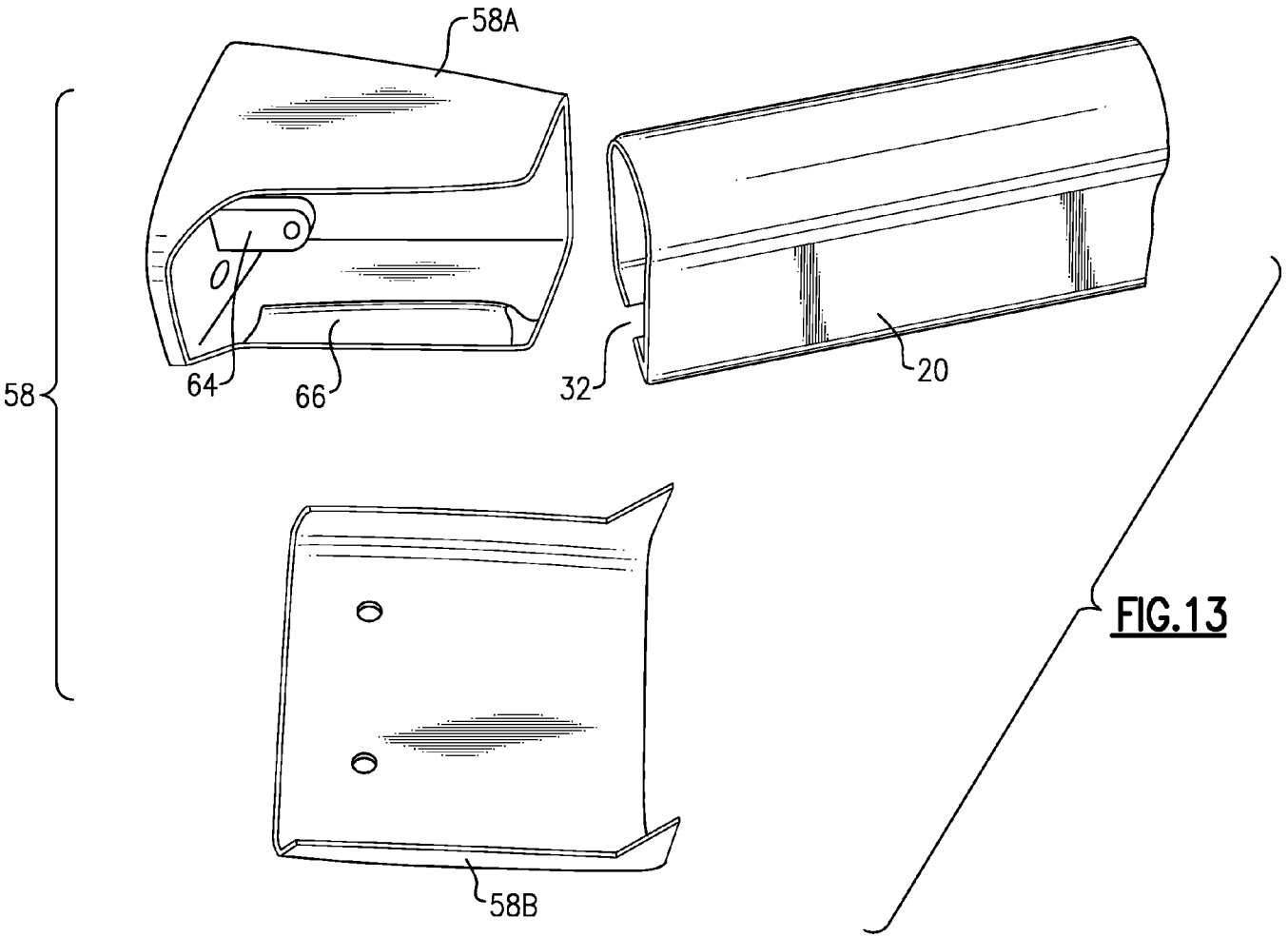
FIG. 13 is an assembly view of the wall mount and shower curtain rod of a preferred embodiment.

FIG. 13 is an assembly view showing the A and B parts 58A, 58B of the right-end clamshell 58 wall mount, plus the rail 20. The mounting screw(s) are omitted in this view. The relation of the rib 66 to the slot 32 at the end of the rail 20 is shown here.

In this embodiment, the two-part end mount 58 is employed. In other embodiments, one-part mounts can be used on each end, with the rail or rod flexed and sprung into place.

Figure 14:
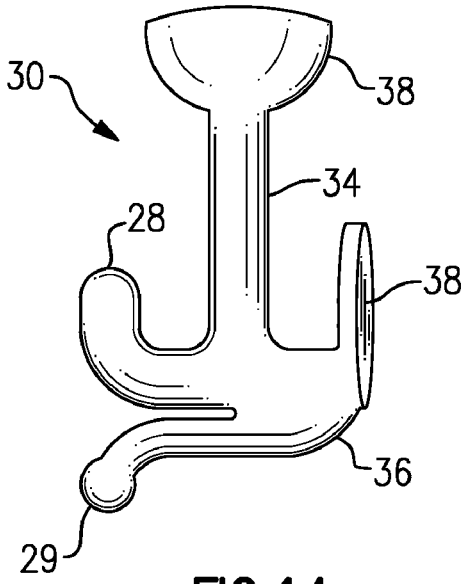
FIG. 14 is a perspective view of the glide of a preferred embodiment.

FIG. 14 shows the glide 30 according to a preferred embodiment of this invention, and the details of the glide are apparent in this view. The glide 30 is formed of nylon or another suitable polymer in a press or mold. The glide has a head 38 in the form of a top ball or hemisphere, a vertical shaft 34 that passes downward from the head 38 through the slot 32 of the rail, a liner hook 28 at the end of the shaft 34, and an associated spring arm 29 that pushes up to accept the liner grommet so that the grommet rests between the hook 28 and the shaft 34. The spring arm 29 then is biased down by spring pressure against the grommet to hold it in place. The spring arm 29 can be squeezed up by finger pressure to allow the liner grommet to be slipped off the hook 28.

A curtain support arm or hook member 36 extends the other direction from the end of the shaft 34, and has a button 38 formed at its end. The button can be a flattened disk, spade, or oval shape. The button 38 secures into one of the eye slots or buttonholes 44 formed in the upper hem of the fabric shower curtain 22.

Figure 15:
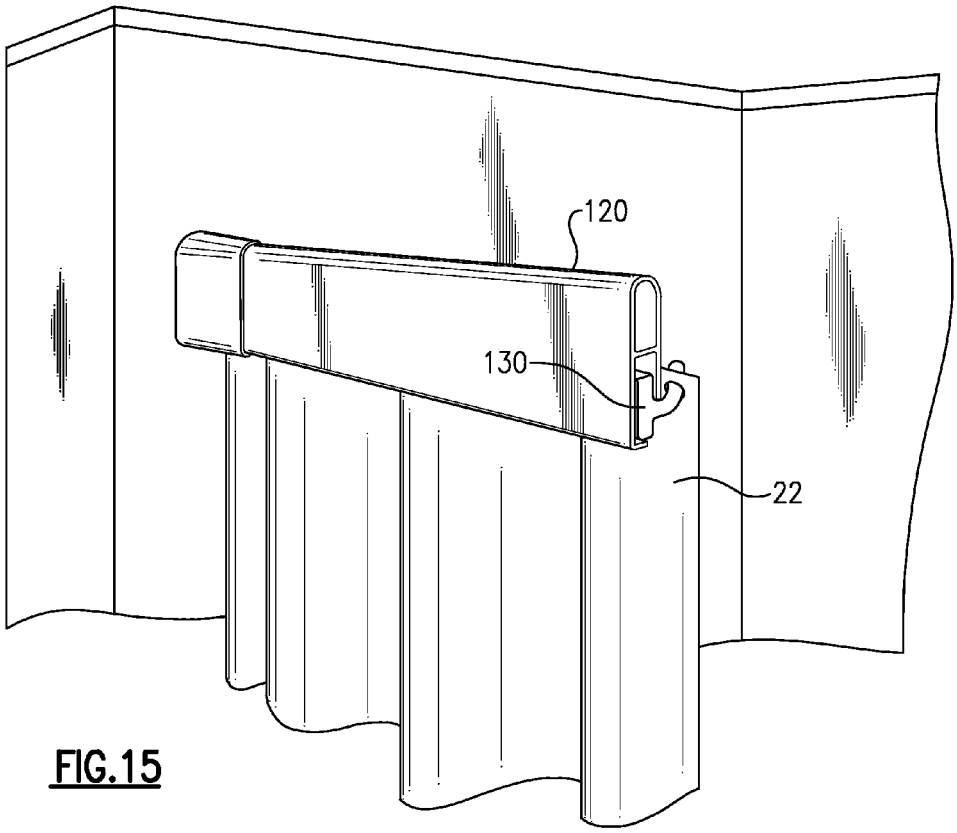
FIG. 15 is a front perspective view of an alternative embodiment of the shower curtain support system of this invention.
Figure 16:
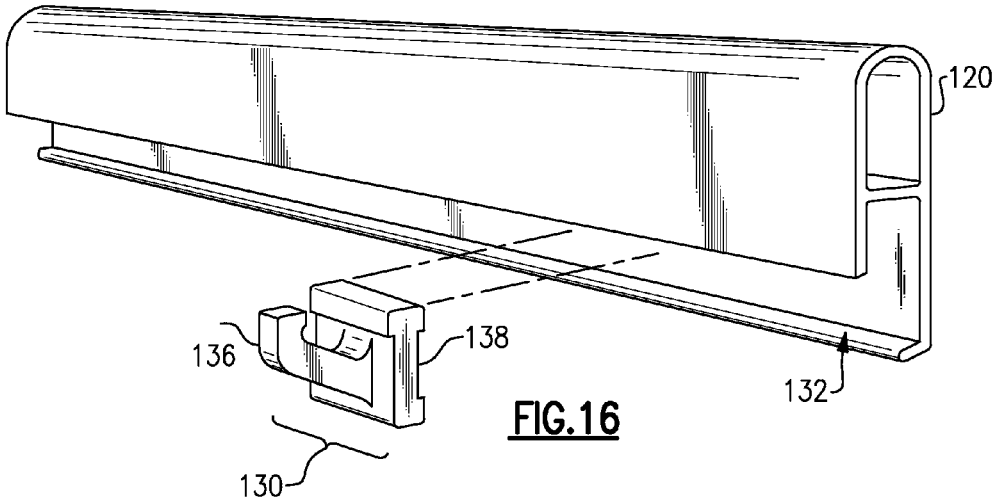
FIG. 16 is a rear perspective thereof.

FIG. 15 is a perspective view of another possible alternative embodiment, in which a corresponding shower curtain rail 120 is an extrusion having a back slot 132, in which there are glide members 130 that support the top of the curtain behind the rail. As shown in more detail in the rear view of FIG. 16, the rail extrusion 120 has an inverted U profile, but the back wall is shortened, leaving a high opening between that and the lip formed on the front wall, on the back or tub side. The glide 130 here in the form of a block 138 that fits into the open back slot. The glide 130 also has a hook arm 136 that projects out from the block 138 on the tub side of the rail to support the curtain and/or liner. The weight of the curtain and liner is sufficient to keep the glide blocks in place in the rail in normal use, but these can be removed or installed when necessary. One end mount is shown in FIG. 15, which can be fastened to the end wall above the tub or shower area.

As in the first-described embodiment, this alternative rail system can be suspended from above, either directly on a ceiling or soffit, or by means of vertical rods or the like.

Figure 17B:
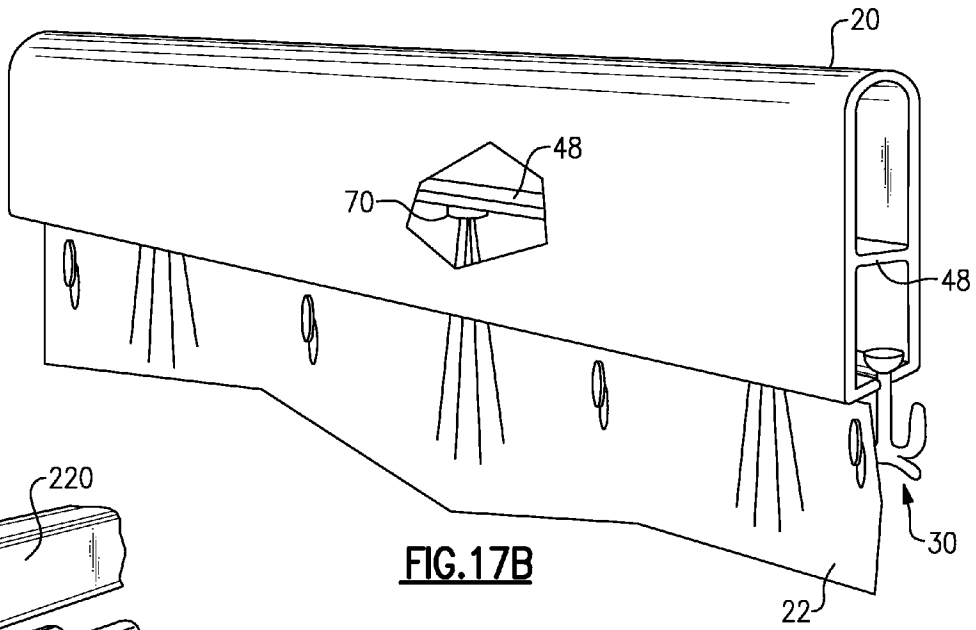
FIG. 17A and FIG. 17B are a sectional view and perspective view of another embodiment, employing illuminating LEDs within the rail extrusion.
Figure 17A:
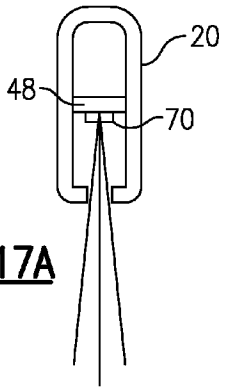

A variation of the first-described embodiment is illustrated in FIG. 17, composed of FIGS. 17A and 17B. This can be identical to the first embodiment, with the exception that here there is a series or sequence of low-power LEDs 70 positioned along the under side of the horizontal brace wall 48 within the shower curtain rail 20. These LEDs emit light that passes down, through the rail slot 32 to bathe the shower curtain in low level illumination. This allows the shower rail and curtain system to serve as a night light. The low-voltage power supply and wiring are not shown here.

Figure 18:
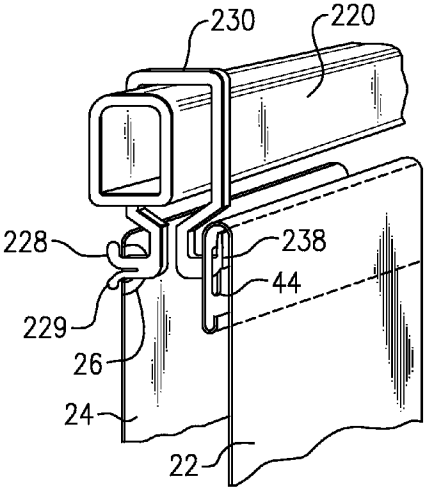
FIG. 18 is a perspective view of a modified shower curtain ring or hook, and a conventional rail or rod, used with the blind-eyelet shower curtain of this invention.

The shower curtain 22 and liner 24 as described above can be used also with a traditional tubular type of shower rod 220, as illustrated in FIG. 18. A ring-type glide 230 shown here fits over the tubular shower rod 220 and can slide along the rod in the usual fashion. At the tub side there is a shower liner hook 228 and associated spring arm 229 for engaging the shower curtain liner grommet 26, and at the other side there is a curtain hook button 238 that fits into the blind eyelet or eye slot 44 at the upper hem of the shower curtain 22. These ring-type glides are shown with a separation at the under side to permit the glides to spring-deflect out and snap over the shower rod when they are installed. This embodiment allows the shower curtain 22, e.g., as shown in FIG. 9, to be retrofitted to an existing shower or bath, using the existing shower rod.

It should be understood that many possible alternative embodiments and variations can be constructed, following the major principles of this invention. Many modifications and variation would be apparent to the person of ordinary skill in this art, without departing from the scope and spirit of the present invention, which can be defined in the appended Claims.

We claim:

1. A shower curtain and suspension system comprising a shower curtain having an upper edge, and with a plurality of eye openings spaced along said upper edge;

a shower curtain rail having an open interior and a slot extending along an under side thereof;

a plurality of glides, each said glide being unitarily formed and having a head member that rides within the rail above said slot, a shaft that projects from said head member and protrudes downwardly through said slot, and a curtain hook member formed at a lower end of said shaft, and attaching onto a respective one of said eye openings of the shower curtain to suspend the shower curtain above a floor of a shower space, such that the upper edge of said shower curtain is beneath the shower curtain rail, with the glides hanging the curtain in hidden fashion so as not to be visible from outside the shower space, but so that the shower curtain rail is visible outside the shower space when the shower curtain is present; and means for suspending the shower curtain rail at an upper part of said shower space;

wherein said means for suspending includes a clam-shell two-part wall mount for supporting one end of said shower curtain rail; with said clam-shell wall mount having an A portion that attaches by a screw fastener into a wall at one end of the shower space, and a B portion that installs over an end of the rail and attaches by one or more threaded fasteners to said A portion, with the A portion having a corresponding blind-threaded hole to receive said one or more threaded fasteners, such that screw fastener hardware in the wall mount is not visible from outside the shower space.

2. A shower curtain and suspension system according to claim 1, wherein said rail is in the form of an extrusion having an upper wall, a pair of side walls, a pair of inwardly directed lips at lower ends of said side walls to define said slot.

3. A shower curtain and suspension system according to claim 1, wherein said rail is in the form of an extrusion having an inverted U-shaped profile.

4. A shower curtain and suspension system comprising a shower curtain having an upper edge, and with a plurality of eye openings spaced along said upper edge;

a shower curtain rail having an open interior and a slot extending along an under side thereof;

a plurality of glides, each said glide being unitarily formed and having a head member that rides within the rail above said slot, a shaft that projects from said head member and protrudes downwardly through said slot, and a curtain hook member formed at a lower end of said shaft, and attaching onto a respective one of said eye openings of the shower curtain to suspend the shower curtain above a floor of a shower space, such that the upper edge of said shower curtain is beneath the shower curtain rail, with the glides hanging the curtain in hidden fashion so as not to be visible from outside the shower space, but so that the shower curtain rail is visible outside the shower space when the shower curtain is present; and means for suspending the shower curtain rail at an upper part of said shower space; and wherein said glides each have a grommet hook and spring arm unitarily formed at a lower end of said the stem of the glide on one side thereof for insertion into a grommet formed in an upper hem of a curtain liner supporting said shower curtain liner, and a button member unitarily formed on the curtain hook at the lower end of said stem at an opposite side from said grommet hook for insertion into one of said eye openings in said shower curtain.

5. A shower curtain and suspension system according to claim 4, wherein said upper edge of said curtain has a hem formed by turning over and sewing a narrow portion of the shower curtain along a back side only of the shower curtain at said upper edge thereof, and said eye openings are formed as narrow blind slits on said narrow portion, and the button member of each of said glides is dimensioned to fit into a respective one of said slits, so as not to be visible from outside the shower space.

6. A shower curtain and suspension system according to claim 5, wherein each said eye opening is formed only on the turned-over narrow portion at said upper edge, such that the eye openings do not penetrate a front side of the shower curtain at the upper edge thereof.

7. A shower curtain and suspension system according to claim 4, wherein said glides each have the head thereof formed as a hemisphere, with a generally spheric surface facing downward, and with the shaft thereof projecting from said spheric surface.

8. A shower curtain and suspension system comprising a shower curtain having an upper edge, and with a plurality of eye openings spaced along said upper edge;

a shower curtain rail having an open interior and a slot extending along an under side thereof;

a plurality of glides, each said glide being unitarily formed and having a head member that rides within the rail above said slot, a shaft that projects from said head member and protrudes downwardly through said slot, and a curtain hook member formed at a lower end of said shaft, and attaching onto a respective one of said eye openings of the shower curtain to suspend the shower curtain above a floor of a shower space, such that the upper edge of said shower curtain is beneath the shower curtain rail, with the glides hanging the curtain in hidden fashion so as not to be visible from outside the shower space, but so that the shower curtain rail is visible outside the shower space when the shower curtain is present;

means for suspending the shower curtain rail at an upper part of said shower space;

wherein said rail is in the form of an extrusion having an upper wall, a pair of side walls, a pair of inwardly directed lips at lower ends of said side walls to define said slot; and wherein said rail member has a round glide insertion opening formed at one end of said rail along one or both of said inwardly directed lips and superimposed on said slot, and further including a leaf retaining spring positioned within said rail and above said glide insertion opening; the leaf retaining spring having a free end at the position of the glide insertion opening and an anchor portion affixed onto the rail above said slot.

9. A shower curtain and suspension system according to claim 8, wherein said extrusion also includes a horizontal wall formed above said lips and below said upper wall, and joining said side walls.

10. A shower curtain and suspension system comprising:

a shower curtain rail traversing a shower space at an elevated position, the rail having an open interior and a slot extending along an under side thereof;

a plurality of glide members each supported in said shower curtain rail and capable of moving slidably within the slot in said rail, each of said glide members being unitarily formed of a generally hemispherical head that is retained in the rail above the slot; a stem projecting downward through the slot, a curtain hook portion positioned on a lower end of said stem below said rail, and a liner hook portion positioned at a lower end of the stem below said rail and opposite the curtain hook portion;

a shower curtain having first and second faces and an upper edge, with a hem formed along said upper edge and with a plurality of eye openings spaced therealong; wherein said hem is formed by turning over and sewing a narrow portion of the shower curtain along the shower curtain at said upper edge, and wherein said eye openings are formed in said hem at said upper edge on one of said first and second faces only, and do not penetrate the other of said first and second faces of the shower curtain; and a shower curtain liner having a plurality of grommets situated along an upper hem thereof defining grommet openings;

wherein said curtain hook portion of each of said glide members includes a button member integrally formed therewith to enter and engage a respective one of said eye openings to support the shower curtain at said elevated position such that the hem of the shower curtain is situated beneath the bar with the bar being exposed to view outside the shower space, and such that said glide including said hook portion is concealed and not visible from outside said shower space;

and said liner hook portion being formed of a grommet hook and a spring arm extending from said stem beneath the spring arm, and being resiliently urged down to secure the grommet on the grommet hook and being yieldable to be squeezed upwards to permit the liner grommet to be removed therefrom.

* * * * *